US011161015B2

(12) United States Patent
Salzer

(10) Patent No.: US 11,161,015 B2
(45) Date of Patent: Nov. 2, 2021

(54) DETACHABLE BALL POCKET AND METHOD FOR USING THE SAME

(71) Applicant: Jennifer E. Salzer, New York, NY (US)

(72) Inventor: Jennifer E. Salzer, New York, NY (US)

( * ) Notice: Subject to any disclaimer, the term of this patent is extended or adjusted under 35 U.S.C. 154(b) by 100 days.

(21) Appl. No.: 16/675,720

(22) Filed: Nov. 6, 2019

(65) Prior Publication Data

US 2021/0128988 A1 May 6, 2021

(51) Int. Cl.
*A63B 47/00* (2006.01)
*A45F 5/02* (2006.01)

(52) U.S. Cl.
CPC ..... *A63B 47/001* (2013.01); *A45F 5/02* (2013.01); *A45F 2005/023* (2013.01)

(58) Field of Classification Search
CPC .... Y10S 224/919; A63B 47/001; A63B 60/58
USPC ..... 206/315.9; 224/251, 919
See application file for complete search history.

(56) References Cited

U.S. PATENT DOCUMENTS 4,301,549 A * 11/1981 Ingram ..... A63B 47/001 2/250
7,322,477 B2 * 1/2008 Schweitz ..... A63B 60/58 206/579
2005/0133130 A1 * 6/2005 Blum ..... A45F 5/00 150/149
2007/0062995 A1 * 3/2007 Kasuli ..... A45F 3/047 224/637
2013/0139299 A1 * 6/2013 Crump ..... A41D 27/20 2/247
2018/0311537 A1 * 11/2018 Alnuaimi ..... A63B 47/001

* cited by examiner

*Primary Examiner* — Scott T McNurlen
(74) *Attorney, Agent, or Firm* — Marcus C. Dawes

(57) ABSTRACT

A disposable and detachable pocket to hold game balls that is initially disposed on or within a game ball container, thereby allowing users to hold multiple game balls while participating in a sporting event. The pocket comprises a substantially horseshoe shaped attachment portion which is initially removably disposed on a bottom surface of a lid of a game ball container with a small netted pouch or net attached. The attachment portion which comprises an adhesive surface may be peeled off the lid and then affixed anywhere on a user's clothes. The adhesive disposed on the attachment portion is durable but does not affect or damage the fabric of the user's clothing. The adhesive is only disposed on the shaped attachment portion so the ease and accessibility of placing or removing game balls from the net is not affected. The detachable pocket is comprised of inexpensive materials can be thrown away after use.

10 Claims, 4 Drawing Sheets

DETACHABLE BALL POCKET AND METHOD FOR USING THE SAME

BACKGROUND

Field of the Technology

The invention relates to the field of sporting equipment and sports training equipment, specifically to adjustable or mobile ball storage devices or hoppers.

Description of the Prior Art

While playing or training for a sport or game such as golf, baseball, or tennis, it can be extremely convenient to have multiple game balls close by so as to not halt play or their training session unnecessarily. For example, when playing tennis, if the ball in play is hit past one of the players it can save time and energy by simply putting a second ball into play instead of stopping the game and waiting until the first ball is retrieved. A problem develops however since it can be difficult if not impossible to hold multiple game balls while also participating in the sport. Several solutions have been developed over time which aim to address this problem to varying degrees of success.

Ball hoppers or baskets have long been used for a variety of sports including tennis, golf, or baseball to store a large quantity of game balls for training or practicing purposes. Typically, the basket or hopper comprises a handle, a stand, and/or a set of wheels which allows the hopper to be placed anywhere the user desired, typically around a tennis court or next to a tee as needed. However while a hopper is capable of accommodating a large amount of game balls, the hopper remains stationary unless specifically moved by the user. Therefore every time the hopper must be moved, the user is forced to stop their training, move or adjust the position of the hopper, and then resume their training. Additionally, going to the hopper to retrieve more game balls every time one is needed can be inconvenient since the hopper may not be located in the same area, court, or field as the user playing the game.

Another solution for accommodating game balls has been to wear a detachable bag or clothing item which specifically comprises pockets for housing one or more game balls. The bag can be incorporated into a belt or alternatively, may include its own dedicated straps or means for being worn on or about the user's body. For a clothing item or a garment such as a pair of shorts, a skirt, or a belt, the clothing item typically includes a dedicated pocket or sleeve which is specifically sized and shaped to accommodate a game ball. As the user plays the sport or completes their training, they may reach into the pocket or sleeve which is typically disposed at or near their lower back whenever a new game ball is needed. A downside to these devices however is that it forces the user to wear a specific clothing item which they may not prefer not to wear or to attach or wear a bag which can be cumbersome or get in the way of the user while training or participating in the game.

Still further solutions have included removable or wearable pockets which are independent pockets that exist outside of the user's normal or standard clothing. The removable pocket does allow the user to wear whatever clothing they like, however many of them require the user to attach or affix the pocket to a specific location such as a belt or to a separate component such as a portion of hook and loop fabric which must separately by attached to the user's clothing in addition in the pocket itself. In other words, a user using one of these removable pockets must therefore attach and carry two components, a first component which attaches to a piece of the user's clothing, and then the pocket which attaches to the first component. Because of this, many removable pockets are too bulky, cumbersome, and inconvenient to use for many players who are also carrying or using other sports equipment at the same time such as tennis rackets, golf clubs, and a number of containers for holding game balls.

What is needed therefore is a device and method which allows a user to easily and conveniently carry a plurality of game balls within easy reach of the user while still being able to wear the clothing of their choice. The device should be incorporable into the user's supplementary sporting equipment thereby making the device highly portable. Additionally, the device should be light enough and comprised of readily usable materials so that it may be disposable and easily replaced. Most importantly, the device should be readily available to the user without any prior planning and therefore should be selectively attachable to other products that the user typically needs to engage in the sport, for example included inside a can of tennis balls. In the event that the user is not prepared with pockets in their clothes, the device should be easily included and incorporated with the other sporting goods. A removable ball holding pocket can be attached as a sticker to the inside of a ball can, racket, or any other sporting device which can be peeled off and utilized by the player to hold balls or other components used in the game.

BRIEF SUMMARY

The current invention provides a device for accommodating a plurality of game balls. The device includes a container which includes a removable lid, an attachment portion, and a net attached to the attachment portion. The attachment portion is specifically removably coupled to a bottom surface of the lid.

In one embodiment, the net of the device is configured to be in a contracted configuration when the attachment portion is attached to the bottom surface of the lid. Additionally, the net is configured to automatically unfold into an expanded configuration as the attachment portion is removed from the bottom surface of the lid.

In another embodiment, the attachment portion of the device includes an adhesive surface. In this embodiment, the bottom surface of the lid may also include a backing which is configured to interact with the adhesive surface of the attachment portion.

In a further embodiment, the device also includes a hoop that is connected to the attachment portion, wherein the hoop and the attachment portion define an opening of the net. Here, the attachment portion has an adjustable shape or body which is configured to match the shape of the backing.

In yet another embodiment, the attachment portion of the device includes a removable insert which is configured to form a frictional fit with the lid of the container. In this embodiment, the net of the device is attached to a circumference of the removable insert. Additionally, the net further includes an elastic segment which, along with the removable insert itself, define an opening of the net.

The invention further provides a method for accommodating a plurality of game balls while participating in a game or training session. The method includes separating a detachable ball pocket from a lid of a container, exposing an adhesive surface of the detachable ball pocket, and then coupling the detachable ball pocket to a first portion of a user's clothing. Next, at least one game ball is disposed into the detachable ball pocket.

In one embodiment, separating a detachable ball pocket from a lid of a container specifically includes peeling an attachment portion off of a surface of the lid. Here, exposing an adhesive surface of the detachable ball pocket is done by peeling the attachment portion from a backing which is disposed on a bottom surface of the lid. Next, the disposing of at least one of the plurality of game balls in the detachable ball pocket includes inserting the at least one game ball into a net that is connected to the attachment portion. The insertion of the at least one game ball into a net is preferably done by inserting the at least one game ball through an opening of the net that is defined between the attachment portion and a hoop coupled to the attachment portion.

In a separate embodiment, separating a detachable ball pocket from a lid of a container includes disengaging an insert from a surface of the lid. In this particular embodiment, the exposure of the adhesive surface of the detachable ball pocket is accomplished by peeling off a backing disposed a back surface of the insert. Next, the disposing at least one of the plurality of game balls in the detachable ball pocket includes inserting the at least one game ball into a net that is connected to a circumference of the insert. The insertion of the at least one game ball into a net coupled to a circumference of the insert is preferably done in this embodiment by inserting the at least one game ball through an opening of the net defined between the insert and an elastic segment disposed within the net.

In yet another embodiment, coupling the detachable ball pocket to a first portion of a user's clothing specifically includes pressing the adhesive surface of the detachable ball pocket against a surface of the first portion of the user's clothing.

In another embodiment, the method also includes removing the detachable ball pocket from the first portion of the user's clothing and recoupling the detachable ball pocket to a second portion of the user's clothing.

While the apparatus and method has or will be described for the sake of grammatical fluidity with functional explanations, it is to be expressly understood that the claims, unless expressly formulated under 35 USC 112, are not to be construed as necessarily limited in any way by the construction of "means" or "steps" limitations, but are to be accorded the full scope of the meaning and equivalents of the definition provided by the claims under the judicial doctrine of equivalents, and in the case where the claims are expressly formulated under 35 USC 112 are to be accorded full statutory equivalents under 35 USC 112. The disclosure can be better visualized by turning now to the following drawings wherein like elements are referenced by like numerals.

The disclosure and its various embodiments can now be better understood by turning to the following detailed description of the preferred embodiments which are presented as illustrated examples of the embodiments defined in the claims. It is expressly understood that the embodiments as defined by the claims may be broader than the illustrated embodiments described below.

DETAILED DESCRIPTION OF THE PREFERRED EMBODIMENTS

Figure 1:
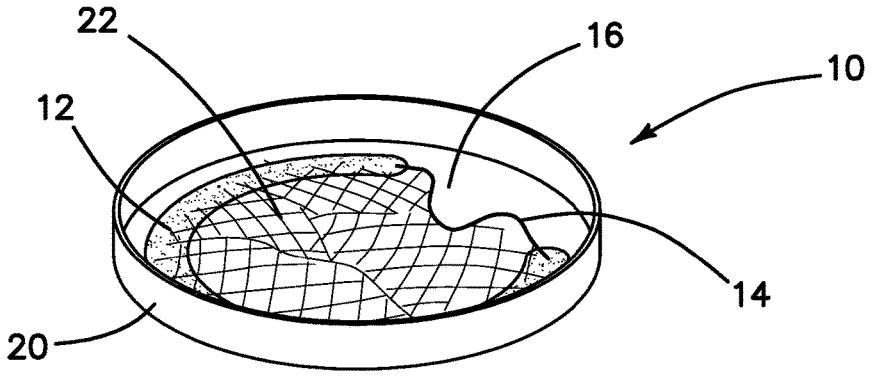
FIG. 1 is a perspective view of the detachable ball pocket of the current invention when it is disposed on the bottom surface of a container lid.

The current invention is a detachable ball pocket which may be seen in detail in FIG. 1 where it is denoted generally with reference 10. The detachable ball pocket 10 comprises a substantially circular hoop 14 or oval which is comprised of metal, fabric, or a segment of rope or cord or other material which is substantially rigid so that the hoop 14 maintains its circular shape. In one particular embodiment, the hoop 14 may be comprised of elastic or other expandable material which allows the hoop 14 to be stretched or manipulated into a specific desired shape or size.

Figure 2:
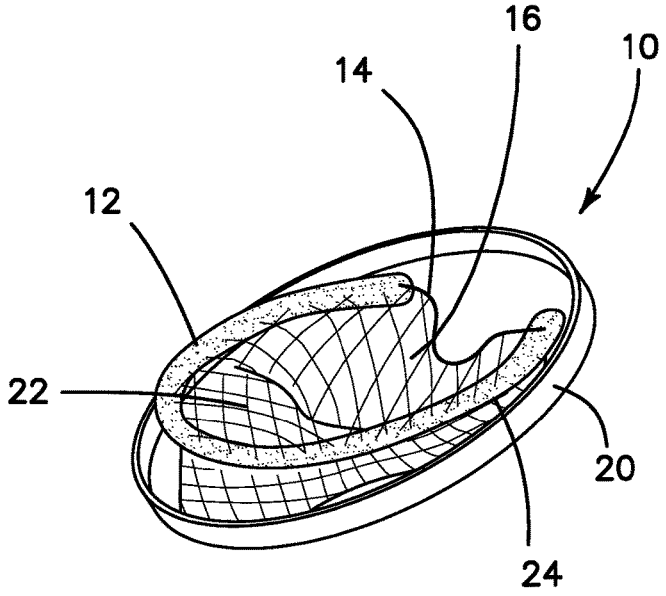
FIG. 2 is a magnified view of the detachable ball pocket seen in FIG. 1 as the detachable ball pocket is being removed from the container lid.

Disposed over a substantial portion of the hoop 14 is a segment of an attachment portion 12. The attachment portion 12 is preferably semi-circular or substantially "horseshoe" shaped, thereby leaving a distal segment of the hoop 14 exposed or uncovered. The attachment portion 12 is preferably comprised of thin plastic, rubber, fabric, or any other material which is lightweight and suitable for maintaining an adhesive substance thereon. The attachment portion 12 may be placed directly over the hoop 14, however in a preferred embodiment, the hoop 14 may be disposed through or sandwiched between at least two layers comprising the attachment portion 12. The attachment portion 12 comprises a top surface and a bottom surface, wherein the bottom surface is covered or otherwise comprises at least one adhesive substance. Additionally, the attachment portion 12 as seen in FIGS. 1 and 2 is substantially wider relative to the hoop 14, therefore the bottom surface of the attachment portion 12 comprising the adhesive substance extends radially beyond the hoop 14. The attachment portion 12 and the hoop 14 cooperate to form an opening 22 which allows the user to insert or remove game balls 18 to and or from the detachable ball pocket 10.

Coupled around the circumference of the hoop 14 is a net 16. The net 16 is preferably comprised of nylon or other suitable lightweight material and is allowed to freely hang downward from the hoop 14 and the attachment portion 12 while in use as is further discussed below. The net 16 may also be comprised of flexible or expandable material so that the net may be enlarged as more game balls 18 are inserted or dropped into it.

The attachment portion 12 is shown in the figures as being semi-circular or "horseshoe" shaped, however this is meant to be for illustrative purposes only. Other shapes including but not limited to a circle, an oval, or another rounded or curved shape may be used without departing from the original spirit and scope of the invention. In one particular embodiment, the attachment portion 12 comprises any shape which is suitable for adhering to the clothing of the user while also providing sufficient space for a logo, advertisement, or other design screen printed onto the surface thereof. In another embodiment, the attachment portion 12 may initially be in a folded or compact configuration and then when removed from an object as discussed further below, may be unfolded or expanded into a larger or final user-ready shape.

Figure 3:
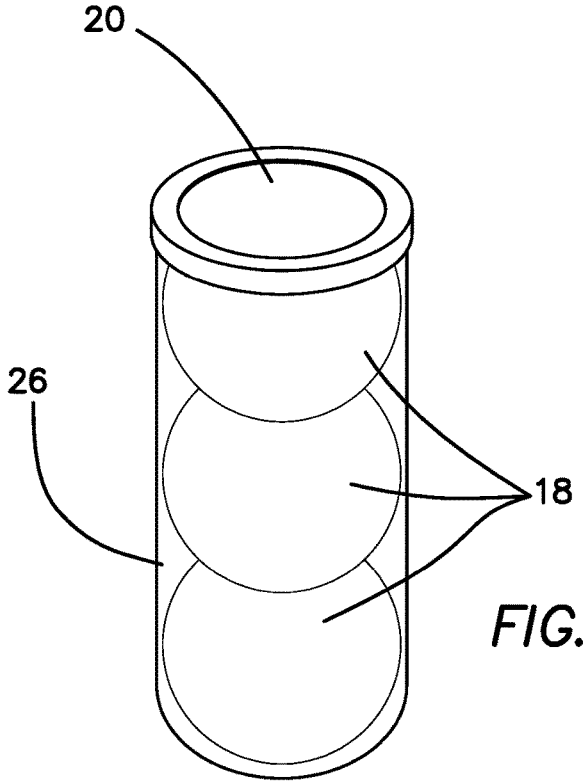
FIG. 3 is a perspective view of a game ball container when the lid comprising the detachable ball pocket is used to seal the game ball container.

The detachable ball pocket 10 is further removably disposed on the underside or bottom surface of a lid 20. The lid 20, which is preferably comprised or metal or plastic, houses or accommodates the detachable ball pocket 10 thereon. As seen in FIG. 3, the lid 20 is a standard sized lid for closing or sealing a container 26 such as a tube or can which accommodates a plurality of game balls 18. While FIG. 3 depicts the container 26 as a can for accommodating or transporting tennis balls, it is to be expressly understood that the container 26 may be any container for accommodating game balls including but not limited to cans, boxes, bags, or any other type of container now known or later devised. The detachable ball pocket 10 is disposed on the bottom surface of the lid 20 so that when the lid 20 is disposed on or is otherwise sealing the container 26, the detachable ball pocket 10 remains within an inside volume of the container 26 so that the profile or footprint of the container 26 remains unaffected by the presence of the detachable ball pocket 10.

Returning to FIGS. 1 and 2, the attachment portion 12 is pressed or removably adhered to the bottom surface of the lid 20 with the net 16 disposed in a folded or contracted configuration between the lid 20 and the attachment portion 12. The attachment portion 12 is removably disposed to the lid 20 through a backing 24 which is in turn disposed on the bottom surface of the lid 20. Specifically, the backing 24 is temporarily affixed to the adhesive surface of the attachment portion 12 so that when the detachable ball pocket 10 is peeled off of or removed from the lid 20 as seen in FIG. 2, the backing 24 remains on the lid 20 which exposes the adhesive disposed on the bottom surface of the attachment portion 12. The backing 24 is configured to temporarily affix to the attachment portion 12 only, thereby leaving the net 16 to freely unfold or expand as the detachable ball pocket 10 is lifted off of the lid 20. The attachment portion 12 and lid 20 are preferably sized and shaped so that the attachment portion 12 is may be temporarily adhered directly to the lid 20, however in a related embodiment, the attachment portion 12 and hoop 14 are adjustable and comprise a degree of flexibility so that they may be manipulated into a contracted configuration in order to fit within the surface area of the lid 20. For example, the opposing ends of the attachment portion 12 may initially be pressed together so that the detachable ball pocket 10 may fit onto the lid 20 but then expand or resiliently bend back into its full or original shape after being removed from the lid 20. Having an attachment portion 12 and hoop 14 which is flexible allows the detachable ball pocket 10 to have a larger opening 22 which is not dictated or limited by the overall size or shape of the lid 20.

To use the detachable ball pocket 10, the user opens the container 26 containing the game balls 18 they wish to use by lifting the lid 20 off of the container 26. The user then inverts the lid 20 thereby exposing the detachable ball pocket 10 as seen in FIG. 1. The user can the peel off or remove the detachable ball pocket 10 by gripping the attachment portion 12 or the hoop 14 or a portion thereof and pulling the detachable ball pocket 10 from the backing 24 permanently disposed on the lid 20. Once free of the lid 20, the net 16 has the necessary space to freely unfold into an expanded configuration as best seen in FIG. 3. Additionally, after removing the detachable ball pocket 10, the user may remove the plurality of game balls 18 disposed therein and then reseal the container 26 with the lid 20 or alternatively dispose of both the lid 20 and container 26 as needed.

Figure 4:
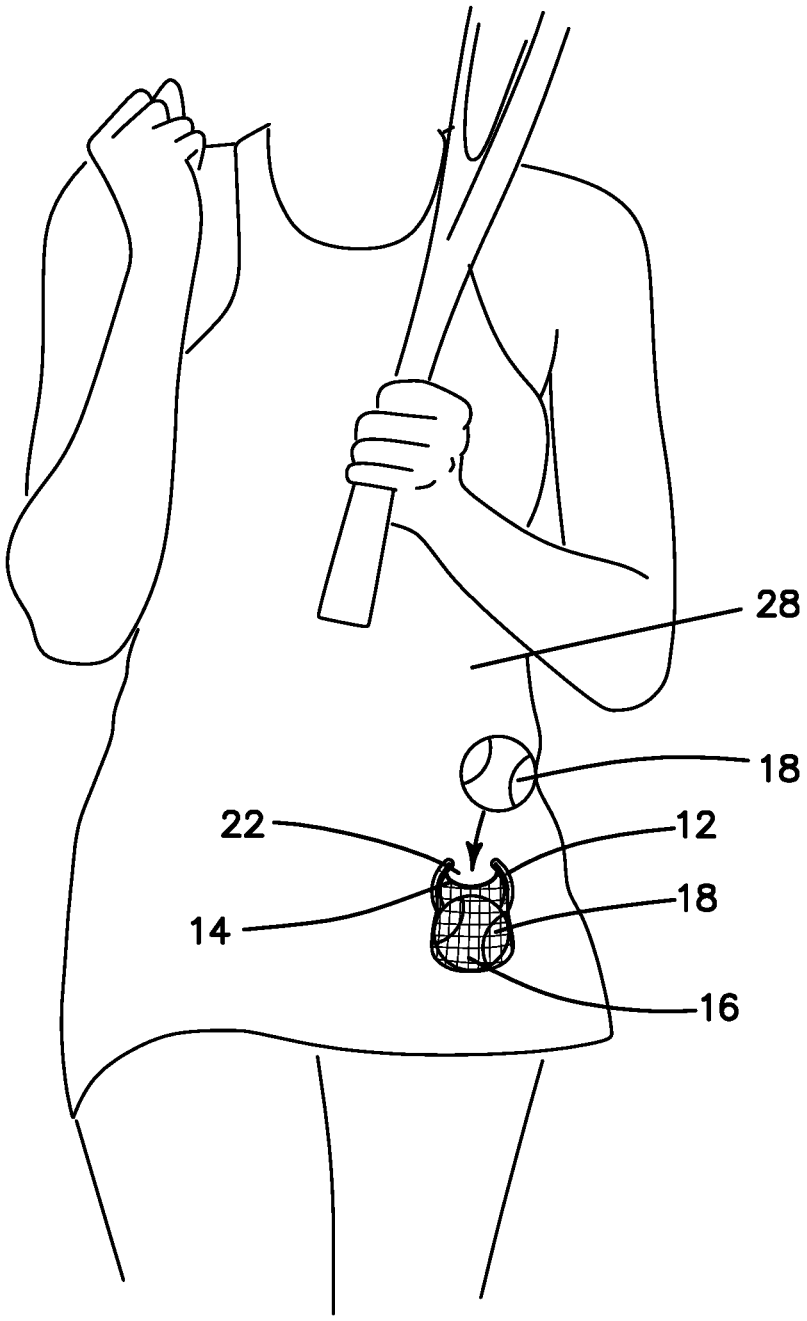
FIG. 4 is a frontal view of the detachable ball pocket seen in FIG. 1 after being removed from the lid of the container and coupled to a portion of the user's clothing.
Figure 5A:
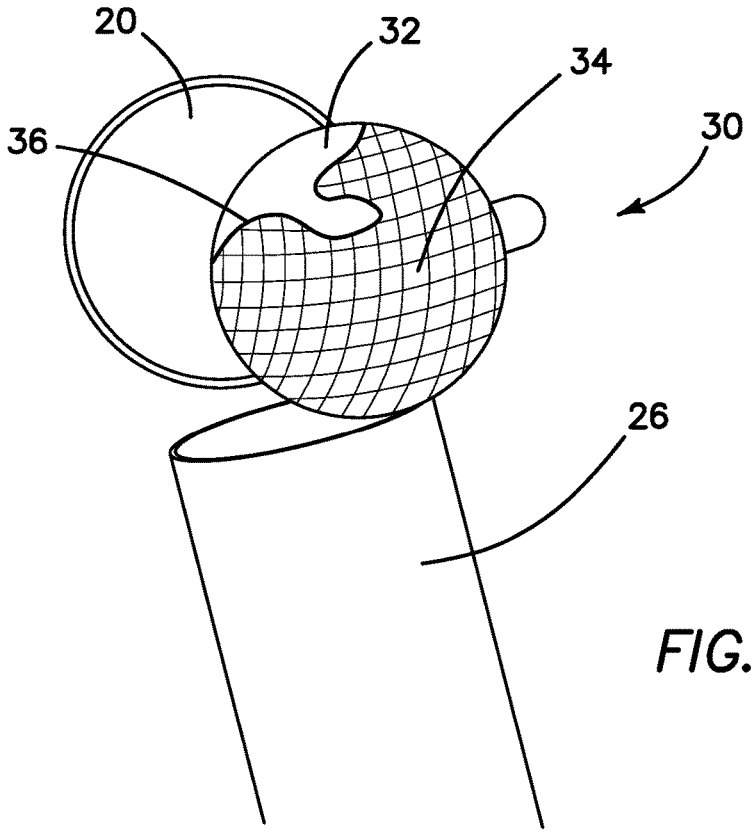
FIG. 5A is a frontal view of an alternative embodiment of the current invention comprising a removable insert as it is being separated from the lid of the container.
Figure 5B:
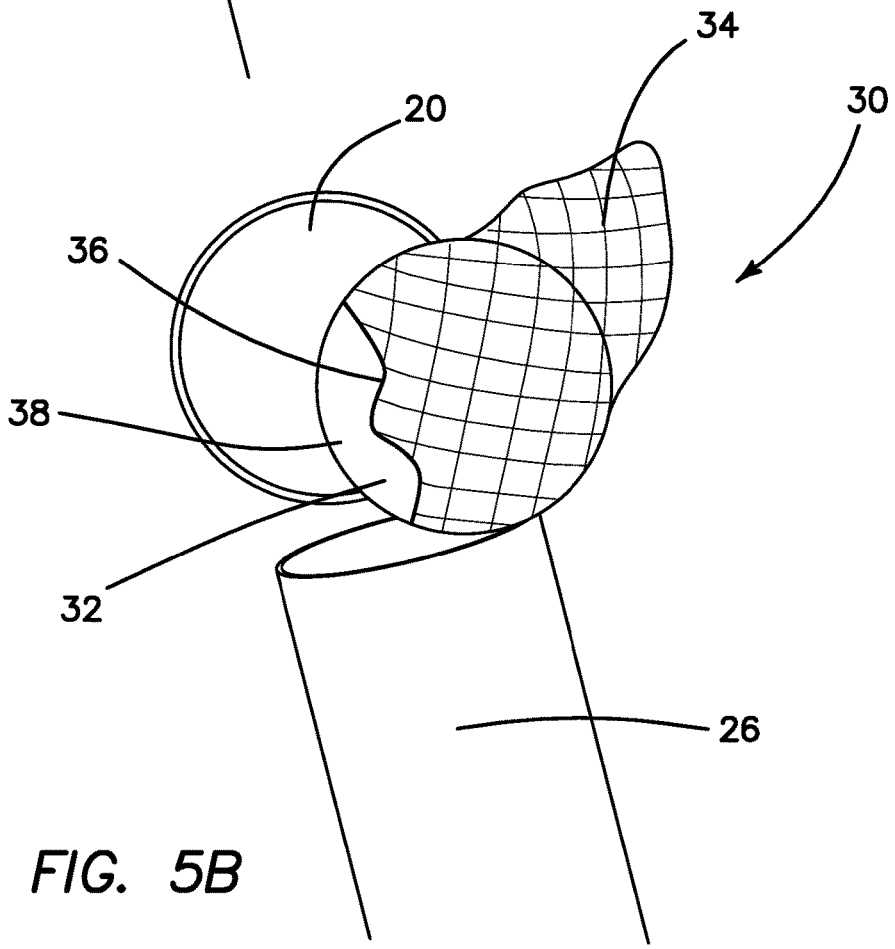
FIG. 5B is a frontal view of the alternative embodiment seen in FIG. 5A after the insert has been removed from the lid and the user has manipulated an elastic segment in order to enlarge an opening of the net.

Turning to FIG. 4, the user may place the detachable ball pocket 10 anywhere on their clothing 28 or person. The detachable ball pocket 10 is temporarily attached or placed onto the user's clothing 28 by pressing the attachment portion 12 against the surface of their clothing 28. The adhesive substance on the bottom surface of the attachment portion 12 ensures that the detachable ball pocket 10 remains in place even when the user stops applying pressure to the attachment portion 12. Next, the user may place one or more game balls 18 into the detachable ball pocket 10 by inserting the game balls 18 through the opening 22 and dropping them into the net 16. The user may participate in the game or engage in their training session with the detachable ball pocket 10 providing a supply of game balls 18 which is close by but yet does not interfere with the game or training session. Specifically, when a new or additional game ball 18 is required, the user may simply reach into the net 16 and remove a game ball 18 from the detachable ball pocket 10 as needed. Additional game balls 18 may be inserted into the detachable ball pocket 10 in order replace the game balls 18 which are removed by the user.

While the adhesive disposed on the bottom surface of the attachment portion 12 is strong enough to maintain the detachable ball pocket 10 in a stationary position determined by the user, the adhesive is not so strong that the detachable ball pocket 10 cannot be removed from the user's clothing 28 and/or reapplied to a different portion of the user's clothing 28 or to a different object altogether. For example, a user wishing to adjust the initial position of the detachable ball pocket 10 may simply grip the attachment portion 12 and peel it away from its initial location and then reapply the detachable ball pocket 10 to a second location by once again pressing the attachable portion 12 against the user's clothing 28 or other object. This process may be repeated for as many times the user's desires or until a preferred location is found. Furthermore, because the adhesive substance is only disposed on the attachment portion 12, accessibility and use of the net 16 remains unaffected no matter where the detachable ball pocket 10 may be disposed or how many times the relative attachment location of the detachable ball pocket 10 is altered. Additionally, it is important to note that the adhesive disposed on the bottom surface of the attachment portion 12 does not destroy or ruin the fabric of the user's clothing 28 wherever it is attached.

After the game or training session the user is participating in has ended, the user may remove the detachable ball pocket 10 from their clothing 28 and simply throw it away since the detachable ball pocket 10 is comprised of relatively inexpensive materials. Alternatively, after being removed, the detachable ball pocket 10 may be reapplied to the lid 20 which may then be replaced onto the container 26.

An alternative embodiment of the detachable ball pocket 30 may be seen in FIGS. 5A-6B. In this embodiment, the detachable ball pocket 30 comprises an attachment portion in the form of a substantially circular shaped insert 32. Coupled around the circumference of the insert 32 is a net 34 which comprises an elastic or stretchable segment 36 that defines an opening 38 between it and the insert 32. Disposed on the back or rear side of the insert 32 is a peel-able or removable backing which, when removed from the insert 32, exposes an adhesive surface which allows the detachable ball pocket 30 to be temporarily adhered or placed to an object or to the clothing 28 of a user.

To use the detachable ball pocket 30, the user opens the container 26 by removing the lid 20. The user then inverts the lid 20 and separates the detachable ball pocket 30 from the lid 20. The detachable ball pocket 30 is preferably sized and shaped to fit just within the circumference of the lid 20 so that the detachable ball pocket 30 may rest on or within the lid 20 through a frictional fit or other coupling means which do not require any additional adhesives, glues, or any other intermediate components.

Figure 6A:
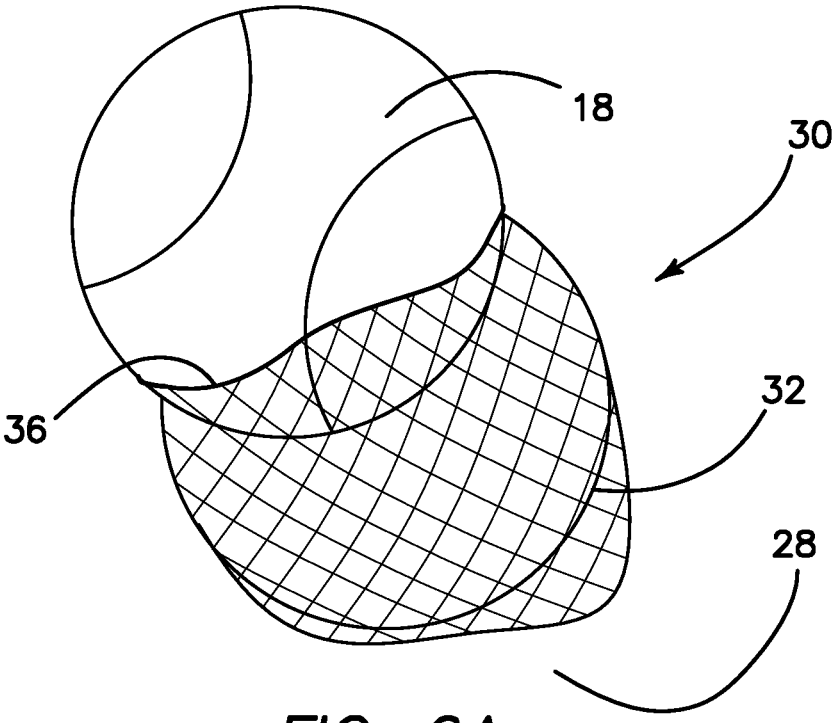
FIG. 6A is a frontal view of the alternative embodiment seen in FIG. 5B after the insert has been attached to a portion of the user's clothing and as the user inserts a game ball into a net portion of the insert.
Figure 6B:
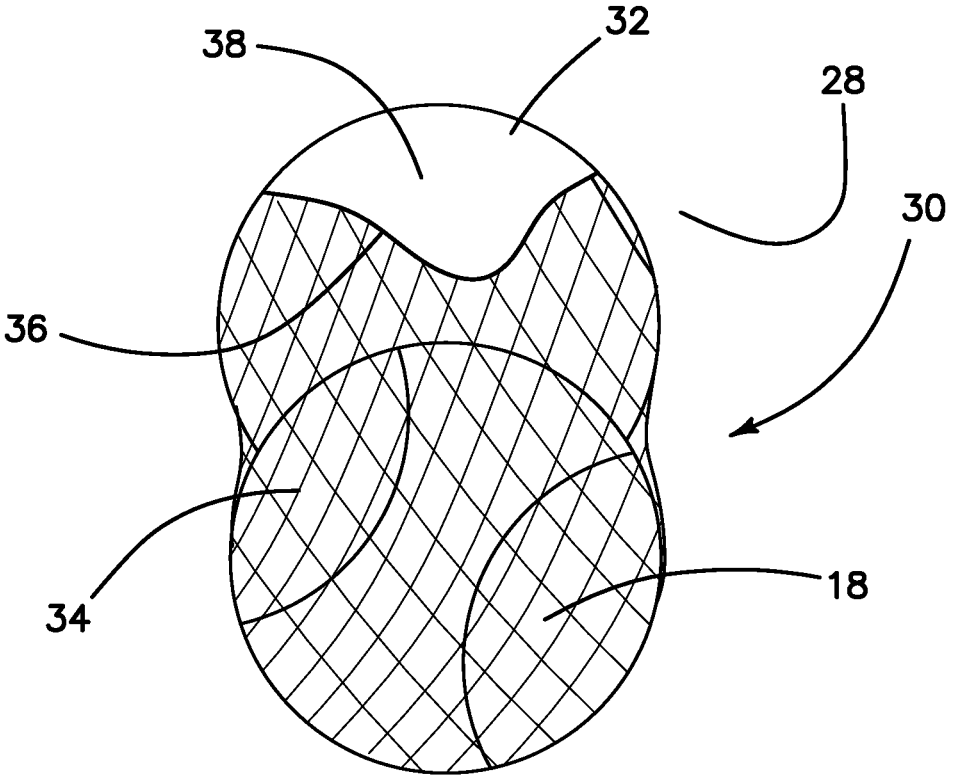
FIG. 6B is a frontal view of the alternative embodiment seen in FIG. 6A after the game ball has been inserted into the net portion of the insert.

After separating the detachable ball pocket 30 from the lid 20, the backing disposed on the back side of the insert 32 is removed, thus exposing the adhesive surface underneath. The detachable ball pocket 30 is then applied to the clothing 28 of the user as is described above. Next, as best seen in FIG. 6A, the user manipulates the elastic segment 36 to enlarge the opening 38 so that a game ball 18 may be inserted therein. Once pushed through the opening 38, the user may release the game ball 18 which is then allowed fall into the net 34. The net 34, which is also comprised of elastic material, freely expands to fully accommodate the game ball 18 as it hangs down from the insert 32 as seen in FIG. 6B. The detachable ball pocket 30 remains in place on the user's clothing 28 for as long as needed, thereby providing the user with a way of temporarily attaching an extra pocket to one or more locations on their clothing 28 of choice. The user may insert or remove additional game balls 18 to or from the net 34 for as long as the detachable ball pocket 30 is applied to the user's clothing 28.

In a related embodiment, the lid 20, the backing 24, and/or the insert 32 may comprise a printed logo, symbol, or other design disposed thereon as desired by a manufacturer. The logo, symbol, or design may be painted, silkscreened, or otherwise applied directly to the lid 20, backing 24, and/or insert 32, or alternatively, the logo, symbol, or design may be applied as a sticker or other adhesive surface to the selected component. In this manner, a manufacturer of the detachable ball pocket 10 may place or insert their own logo in order to identify themselves as the source of the detachable ball pocket 10, or alternatively, a manufacturer or other retailer may apply selected advertising for other products or services as desired.

Many alterations and modifications may be made by those having ordinary skill in the art without departing from the spirit and scope of the embodiments. Therefore, it must be understood that the illustrated embodiment has been set forth only for the purposes of example and that it should not be taken as limiting the embodiments as defined by the following embodiments and its various embodiments.

Therefore, it must be understood that the illustrated embodiment has been set forth only for the purposes of example and that it should not be taken as limiting the embodiments as defined by the following claims. For example, notwithstanding the fact that the elements of a claim are set forth below in a certain combination, it must be expressly understood that the embodiments includes other combinations of fewer, more or different elements, which are disclosed in above even when not initially claimed in such combinations. A teaching that two elements are combined in a claimed combination is further to be understood as also allowing for a claimed combination in which the two elements are not combined with each other, but may be used alone or combined in other combinations. The excision of any disclosed element of the embodiments is explicitly contemplated as within the scope of the embodiments.

The words used in this specification to describe the various embodiments are to be understood not only in the sense of their commonly defined meanings, but to include by special definition in this specification structure, material or acts beyond the scope of the commonly defined meanings. Thus if an element can be understood in the context of this specification as including more than one meaning, then its use in a claim must be understood as being generic to all possible meanings supported by the specification and by the word itself.

The definitions of the words or elements of the following claims are, therefore, defined in this specification to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptionally equivalent, what can be obviously substituted and also what essentially incorporates the essential idea of the embodiments.

I claim:

1. A method for accommodating a plurality of game balls while participating in a game or training session, the method comprising:

separating a detachable ball pocket from a lid of a container;

exposing an adhesive surface of the detachable ball pocket;

coupling the detachable ball pocket to a first portion of a user's clothing; and disposing at least one of the plurality of game balls in the detachable ball pocket, wherein separating a detachable ball pocket from a lid of a container comprises peeling an attachment portion off of a surface of the lid.

2. The method of claim 1 wherein exposing an adhesive surface of the detachable ball pocket comprises peeling the attachment portion from a backing which is disposed on a bottom surface of the lid.

3. The method of claim 1 wherein coupling the detachable ball pocket to a first portion of a user's clothing comprises pressing the adhesive surface of the detachable ball pocket against a surface of the first portion of the user's clothing.

4. The method of claim 1 wherein disposing at least one of the plurality of game balls in the detachable ball pocket comprises inserting the at least one game ball into a net coupled to the attachment portion.

5. The method of claim 4 wherein inserting the at least one game ball into a net coupled to the attachment portion comprises inserting the at least one game ball through an opening of the net defined between the attachment portion and a hoop coupled to the attachment portion.

6. The method of claim 1 further comprising removing the detachable ball pocket from the first portion of the user's clothing and recoupling the detachable ball pocket to a second portion of the user's clothing.

7. The method of claim 1 wherein the attachment portion is an insert.

8. The method of claim 7 wherein exposing an adhesive surface of the detachable ball pocket comprises peeling off a backing disposed on a back surface of the insert.

9. The method of claim 7 wherein disposing at least one of the plurality of game balls in the detachable ball pocket comprises inserting the at least one game ball into a net coupled to a circumference of the insert.

10. The method of claim 9 wherein inserting the at least one game ball into a net coupled to a circumference of the insert comprises inserting the at least one game ball through an opening of the net defined between the insert and an elastic segment disposed within the net.

* * * * *